US006308908B1

(12) United States Patent
Marchante

(10) Patent No.: US 6,308,908 B1
(45) Date of Patent: Oct. 30, 2001

(54) MACHINE FOR COILING A FLAT CONTINUOUS ELEMENT TO FORM ROLLS

(75) Inventor: Innocente Marchante, Le Bourget-du-Lac (FR)

(73) Assignee: Darlet Marchante Technologie S.A., Le Bourget du Lac (FR)

( * ) Notice: Subject to any disclaimer, the term of this patent is extended or adjusted under 35 U.S.C. 154(b) by 0 days.

(21) Appl. No.: 09/319,010

(22) PCT Filed: Dec. 12, 1997

(86) PCT No.: PCT/FR97/02292

§ 371 Date: Jun. 29, 1999

§ 102(e) Date: Jun. 29, 1999

(87) PCT Pub. No.: WO98/25844

PCT Pub. Date: Jun. 18, 1998

(30) Foreign Application Priority Data

Dec. 12, 1996 (FR) ..... 96 15527

(51) Int. Cl.[7] ..... B65H 35/04

(52) U.S. Cl. ..... 242/527.3; 242/532.3; 242/533.6; 242/906

(58) Field of Search ..... 242/532, 532.3, 242/527.5, 527.6, 527.7, 527.2, 526.3, 533.4, 533.5, 533.6, 906

(56) References Cited

U.S. PATENT DOCUMENTS

| | | | | |
|---|---|---|---|---|
| 2,969,930 | | 1/1961 | Zernov . | |
| 3,383,062 | | 5/1968 | Meihofer et al. . | |
| 3,592,403 | * | 7/1971 | Schmitt | 242/527.5 |
| 4,431,140 | * | 2/1984 | Tetro | 242/532.3 |
| 4,458,852 | * | 7/1984 | Calvert et al. | 242/532.3 |
| 4,529,141 | | 7/1985 | McClenathan . | |
| 4,541,583 | * | 9/1985 | Forman et al. | 242/532.3 |
| 4,690,346 | * | 9/1987 | Takeda et al. | 242/532.3 |
| 4,775,110 | * | 10/1988 | Welp et al. | 242/532.3 |
| 5,988,557 | * | 11/1999 | Moller et al. | 242/532 |

FOREIGN PATENT DOCUMENTS

| | | |
|---|---|---|
| 2 165 077 | 8/1972 | (DE) . |
| 2 218 939 | 10/1973 | (DE) . |
| 88 15 296 | 3/1989 | (DE) . |
| 195 07 799 A1 | 9/1996 | (DE) . |
| 0 543 788 A1 | 5/1993 | (EP) . |
| 1.601.207 | 7/1970 | (FR) . |
| 83 08624 | 12/1983 | (FR) . |

OTHER PUBLICATIONS

Patent Abstracts of Japan, Pub. No. JP–A–03–293250, Dec. 1991.

Patent Abstracts of Japan, Pub. No. JP–A–61–033453, Feb. 1986.

Patent Abstracts of Japan, Pub. No. JP–A–63–082272, Apr. 1988.

* cited by examiner

*Primary Examiner*—Katherine A. Matecki
(74) *Attorney, Agent, or Firm*—Oliff & Berridge, PLC

(57) ABSTRACT

The machine is equipped with a device for cutting the sheet to shift from one roll to another; the cutting device comprises a stand (3) on which a turret (2) has been mounted, said turret bearing at least two parallel spindles (1), each linked to rotating driving means known in the art; the rotation of the turret simultaneously removes a full roll and brings an empty spindle to the coiling station. A carriage (5) capable of motion perpendicular to the spindle axis conveys cylinders to load the machine with sheets to be rolled. The carriage (5) of the machine comprises a cylinder (16) for measuring the tension at which the position of the approaching sheet (F) is approximately horizontal; a contact cylinder (14) in contact with the roll at the coiling station, which is placed underneath and more or less in a vertical line with the tension measuring cylinder (16); a cutting device (11) positioned between the tension measuring and contact cylinders (16, 14) respectively, upstream of the coiling point onto the spindle or the roll to be formed.

19 Claims, 5 Drawing Sheets

MACHINE FOR COILING A FLAT CONTINUOUS ELEMENT TO FORM ROLLS

BACKGROUND OF THE INVENTION

The subject of the present invention is a machine for coiling or winding a continuous flat element to form coils or reels.

Coiling or reel-winding machines are used in a great many branches of industry in which the machines and methods involved culminate in the continuous manufacture of a flat element of some arbitrary width and variable thickness. The flat elements produced by the manufacturing lines have to be coiled or wound so that they can easily be transported to subsequent transformation stages.

This is, in particular, the case in industrial methods and machines for the continuous manufacture of woven fabrics, paper, plate, plastic films and sheets, nonwovens etc. For reasons of simplicity, it is the term "sheet" which will be used hereafter to denote these different types of flat element. In the domain of plastics, the winding machines are used as a matter of course at the end of the manufacturing lines that manufacture plastic film in materials as diverse as polypropylene, polyester, PVC, polyethylene, complex coextruded sheets, etc.

Most of these industrial methods run continuously, the machines practically never being shut down, except for maintenance operations which are several weeks, if not several months, apart.

Furthermore, for them to remain easy to handle, and for other reasons associated with coiling or winding machine techniques, the possibilities of increasing the diameter of the coils or reels of coiled or wound product are not unlimited. It is therefore necessary that the coiling or winding machines used on continuous manufacturing lines be equipped with devices which make it possible, without interrupting production, to change over from a full coil or reel, when the latter has reached the intended diameter, to a new empty coil or reel. It is obvious that such an operation which has to be performed continuously, requires that at a given moment, the sheet be cut at the line production rate and led by appropriate devices onto the core of the new coil or reel back onto which it is to be fed.

It is these devices which are known as sheet cutting systems for automatic coil or reel changeover on coiling or winding machines.

Coiling or winding machines that allow this type of application all exhibit a certain number of common features, which are as follows:

As FIG. 1 shows, several coiling or winding spindles (1), generally two of these, are each equipped with their drive device and are mounted securely on a rotary assembly known as a turret (2) mounted on a stand (3).

At a given moment, each spindle (1) with its associated drive device receives the sheet (F) arriving continuously from the production line, the drive system and its control module delivering the spindle the torque needed for the sheet to be driven at the desired speed and under the desired tension. The devices needed to regulate the torque are either dancing rollers, or electronic tension gauging systems situated upstream of the spindle (1) and tasked with continuously measuring the tension in the sheet (F) so as to automatically control the motor as a function of a pre-established coiling or winding requirement.

In other types of coiling or winding machine, which will be mentioned later, the spindle itself is not driven, but it is a contact roll (4), which is itself driven, which delivers the torque needed for coiling or winding.

When the amount of product coiled or wound on a spindle is such that the maximum diameter has been reached, then, through an operation of rotating the turret (2), without cutting the sheet (F), the empty spindle, which in the meantime has been brought up to the desired speed by its own regulation system, comes into contact with the sheet (F) that is to be coiled or wound, the full coil or reel then finding itself in the so-called off-loading position, but continuing to drive the product, as shown in FIG. 1.

It is at this instant that the automatic cutting device comes into operation to allow the sheet to be moved over from the full coil or reel onto the coil or reel back onto which it is to be fed, without any reduction in production speed.

The way in which this device is constructed depends greatly on the way in which the components upstream of the turret/spindle assembly are constructed, components whose function it is to feed through the product that is to be coiled or wound in a suitable way while at the same time allowing the drive devices to be regulated.

These drive devices generally consist of one or more rolls each fulfilling clearly defined functions and which are generally secured to a moving carriage (5) allowing the abovementioned rolls to maintain a constant geometric arrangement as the diameter of the coil or reel increases as coiling or winding progresses.

FIG. 2 depicts an alternative form of the machine of FIG. 1.

Such machines are used for winding very wide plastic sheets (up to 8 and 9 meters wide) of thin film of between 5 and 100 microns thick, but generally between 10 and 30 microns thick, and at speeds that can be as much as several hundred meters per minute.

As FIG. 2 shows, to wind this type of product, it is generally necessary for the carriage (5) to carry at least two rolls, of which a first roll (6), known as the tension-measuring roll, is equipped with an electronic gauge for continuously measuring the tension in the sheet (F), or is preceded by a dancing roller which fulfils the same function. This roll (6) must be positioned in such a way that the sheet arrives at the roll in a horizontal position (either from above or from below) so that, as the carriage moves as a result of the increase in the diameter of the reel, the angle of wrap of the sheet around the roll is not altered so that the tension reading is not disturbed by any change in wrap angle.

A second roll, known as the contact roll (4) is also needed to guide the sheet to the coiling or winding point. There are two types of coiling or winding commonly used—so-called contact coiling or winding, as shown in FIG. 3, during which the contact roll exerts light pressure on the coil or reel that is being coiled or wound, so as to expel the air which might otherwise become trapped in great quantities in the coil or reel because of the speed at which the sheet is coiled or wound, and coiling or winding known as "gap" coiling or winding, as shown in FIG. 4, in which the contact roll (4) is a short distance that is kept more or less constant away from the coiling or winding point. This type of coiling or winding is preferred when the speed is low because the risk of trapping air is then low, or alternatively when the thickness of the product that is to be coiled or wound is not very uniform and operation of the contact type would be liable to damage the coiled or wound product.

In simplified devices, just one roll is used, tension measurement taking place upstream of or at the entry to the coiling or winding machine.

In more complicated devices, either dancing rolls or so-called smoothing rolls (8), which are also mounted on the carriage (5), are added to the two rolls mentioned earlier.

The sheet, preferably fed in horizontally, may pass either over or under the set of rolls mounted on the carriage. This choice has very substantial consequences on the nature of the cutting system.

If the sheet is fed in from underneath the rolls on the carriage, it will naturally be made to pass over the spindle back onto which it is to be fed. In the reverse scenario, the sheet will pass under the spindle back onto which it is to be fed.

This direction of path therefore has a direct influence on the position of the cutting systems which, in traditional systems representing the state of the art, have, of necessity, to be on that side of the spindle past which the sheet passes.

FIG. 5 shows a coiling or winding machine equipped with a cutting device. This cutting device has to be operated automatically when cutting is desired, cutting having to be achieved in such a way that it disrupts the travel of the sheet as little as possible, the cutting point having to be chosen in such a way that the sheet, immediately after cutting, or, in the case of gradual cutting, the point corresponding to the start of the cut, can easily coil or wind around the spindle (1) back onto which it is to be fed so as to start that coil or reel. To achieve this objective, it is generally necessary for the cutting device to have wrapping rollers (9) bringing the sheet (F) in near to the spindle (1) onto which it is to be fed. The device must provide, in addition to the cutting system with a fixed blade (10) or moving cutters, means of guiding the sheet against the new spindle and which are either air jets or systems of brushes, or so-called electrostatic systems (11) generating electrostatic charge at the surface of the sheet to make sure that the cut sheet contacts the metal spindle back onto which it is to be fed. In some instances, adhesive tapes or possibly vaporized liquid jets are used to ensure reliable contact.

The multitude of functions to be fulfilled by the cutting device means that this device is generally complicated and bulky and that it only works if the layout in space of all the elements that make up the spindle back onto which the sheet is to be fed, and the cutting system proper, are very clearly defined.

This is why these devices are generally situated in close proximity to, but just after, the spindle back onto which the sheet is to be fed. This is because the position of this spindle is clearly defined by virtue of the system comprising stand (3) and turret (2), the position of the sheet (F) is clearly defined by virtue of the moving carriage (5), and finally, the wrapping rollers (9) mounted on the automatic cutting device allow the sheet (F) to be positioned practically independently of the diameter of the finished coil or reel.

This last point has a highly detrimental consequence on the use of the production lines because it imposes the fact that cutting and coil or reel changing can be performed automatically only onto an empty spindle, so that the geometry indicated above is perfectly defined.

Now, in almost all industrial processes that employ very wide thin sheets at high speed, there are a certain number of unpredictable production incidents which sometimes lead to breakages of the sheet, for example as a result of the presence of a foreign body in the sheet or as a result of a handling error on the manufacturing line, or any other arbitrary reason. In general, as the production conditions can be re-established almost instantly, the sheet becomes available again and ready to be coiled or wound very soon after the breakage. If this breakage has occurred very shortly after a coil or reel has been begun, this coil or reel will not have a very large diameter, and the obligation to use the automatic cutting device only in proximity to an empty spindle means that it is compulsory, with the current design of device, to restart the coil or reel on a new spindle. When this occurs, the loss of production that the break represents, and which is generally small, is increased dramatically by the fact that the coil or reel begun previously is not of a large enough diameter that it is economically viable to use it in subsequent transformation processes.

This aspect may be further exacerbated if, as unfortunately does occur sometimes, a second breakage then occurs before the new coil or reel has reached an economically viable diameter. In this case, it is the entire production corresponding to two started, but not full enough coils or reels, which is lost.

SUMMARY OF THE INVENTION

The object of the invention is to provide a coiling or winding machine which has a device that makes it possible to avoid production losses by allowing a sheet to be cut automatically at the end of the coiling or winding of a coil or reel and allowing it to be coiled or wound onto an empty spindle intended to support another coil or reel, and which also allows coiling or winding to start, not onto an empty spindle, as was the case in the existing devices, but onto a coil or reel that has already been begun, irrespective of the diameter of the coil or reel in question.

To this end, the machine to which it relates, of the type comprising a stand on which is mounted a turret equipped with at least two parallel spindles each associated with rotational drive means known in the art, the rotation of the turret simultaneously allowing a full coil, or reel, to be removed and an empty spindle to be brought up to the coiling or winding station, and a carriage that can move at right angles to the axis of the spindles and which itself bears rolls for supplying the machine with sheet that is to be coiled or wound, is characterized in that the carriage comprises a tension measuring roll for measuring tension on which the sheet arrives roughly horizontally, a contact roll for contact with the coil or reel at the coiling or winding station, this roll being placed beneath the tension-measuring roll, roughly vertically in line therewith, and a cutting device placed between the two rolls that are, respectively, the tension-measuring roll and the contact roll, upstream of the point of coiling or winding onto the spindle or the coil or reel that is to be formed. The tension-measuring roll measures tension in a manner known in the art and described on page 3.

As the cutting device is located between the tension-measuring roll and the contact roll, that is to say before the point of coiling or winding onto the spindle or onto the coil or reel back onto which the sheet is to be fed, the position of the sheet to be cut is perfectly defined, irrespective of the diameter of the spindle or of the coil or reel back onto which the sheet is to be fed.

According to one feature of the invention, the tension-measuring roll and the contact roll are motorized.

The tension of the sheet is therefore perfectly monitored because of the proximity of the tension roll, and is pressed firmly against the spindle or the coil or reel back onto which it is to be fed by the contact roll.

To perform this type of cutting, it is beneficial to use moving cutters, the speed of travel of which is roughly equal to the speed of travel of the sheet. Under these conditions, the angle of the cut makes an angle of 45° with the sheet pay-out axis, and this makes it easier for the sheet to be set in place on the spindle or the coil or reel back onto which it is to be fed, because this part that is to be set in place forms a point.

Advantageously, the machine is equipped with control means which, prior to cutting, cause an increase in the tension of the sheet in the region between the tension-measuring roll and the coiling or winding point by altering the speed at which the spindle and/or the speed at which the tension-measuring roll are driven, and an increase in the pressure with which the contact roll is pressed against the spindle or the coil or reel. The conditions for cutting and for coiling or winding onto the new support are perfectly fulfilled by virtue of the increase in the tension in the sheet and of the increase in the pressure with which the contact roll presses against the spindle or the coil or reel back onto which the sheet is to be fed. The sheet is thus perfectly flat with a slight overpressure beneficial to good penetration of the cutters and a clean and swift cut. The cut point, driven along by the speed of the sheet itself, very swiftly passes between the two rolls. To make sure that it coils or winds around the spindle or around the coil or reel rather than around the contact roll, a deionization device is provided and is activated just before cutting, to eliminate the electric charge from the surface of the contact roll.

Furthermore, still with a view to encouraging the end of the sheet to coil or wind around the coil or reel or the spindle, the cutting device comprises, near to the guide for the cutters, an ionizing bar extending transversely across the sheet and activated just before cutting so as to electrostatically charge the sheet and create attraction between the cut part and the coiling or winding spindle.

BRIEF DESCRIPTION OF THE DRAWINGS

In any case, the invention will be clearly understood with the aid of the description which follows, with reference to the appended diagrammatic drawing which, by way of non-limiting example, represents one embodiment of this machine:

FIG. 6 depicts a coiling or winding machine of the same type as those described earlier, and in which the same elements are denoted by the same references as before.

DETAILED DESCRIPTION OF THE INVENTION

Figure 1:
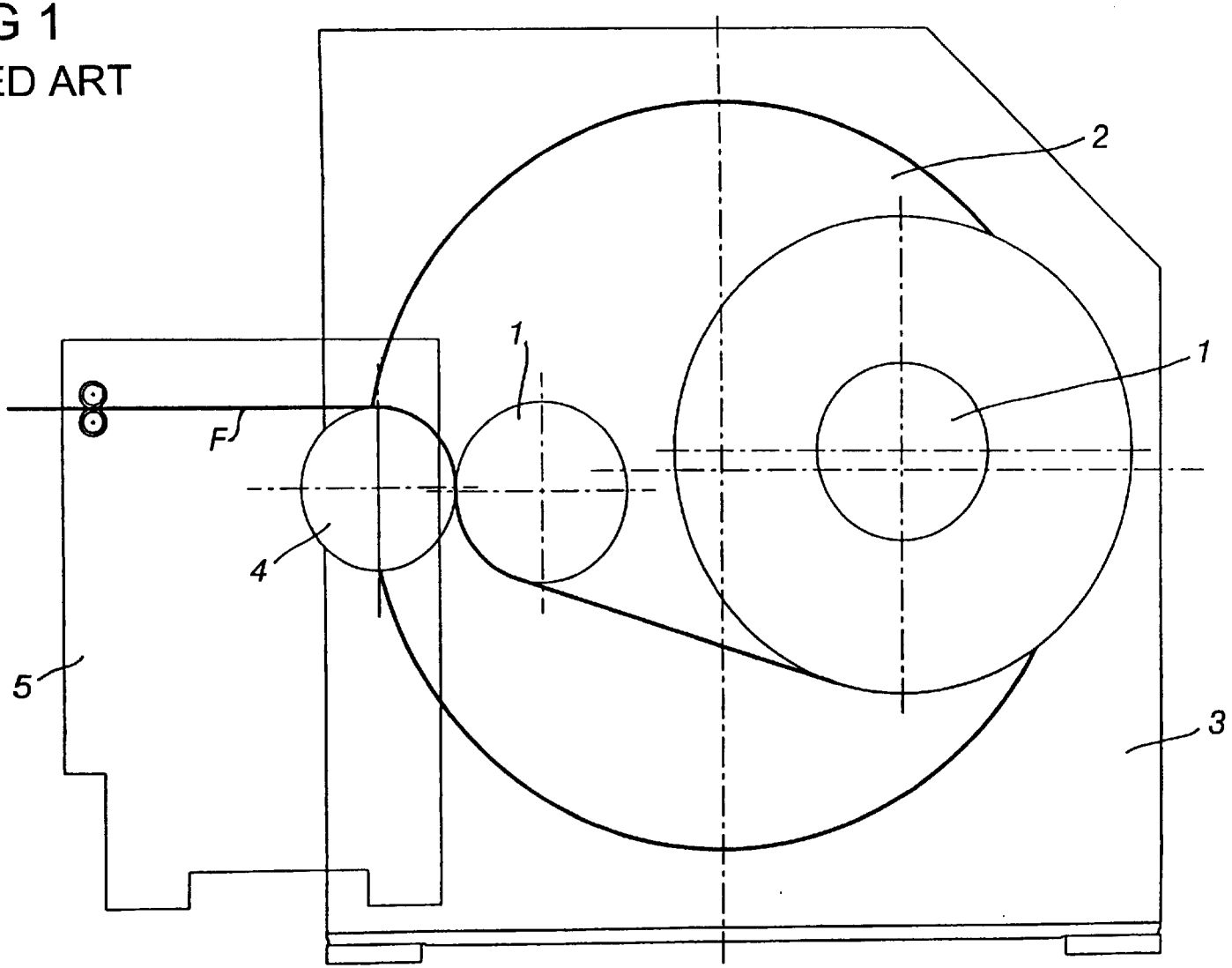
FIG 1 RELATED ART
FIGS. 1 and 2 are two very diagrammatic views of a coiling or winding machine.
Figure 3:
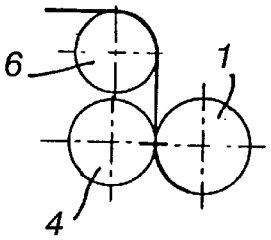
FIG 3 RELATED ART
FIGS. 3 and 4 are two views illustrating two possibilities for feeding the sheet onto the spindle onto which it is to be coiled or wound.
Figure 4:
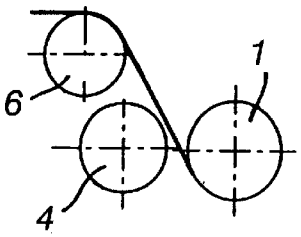
FIG 4 RELATED ART
Figure 2:
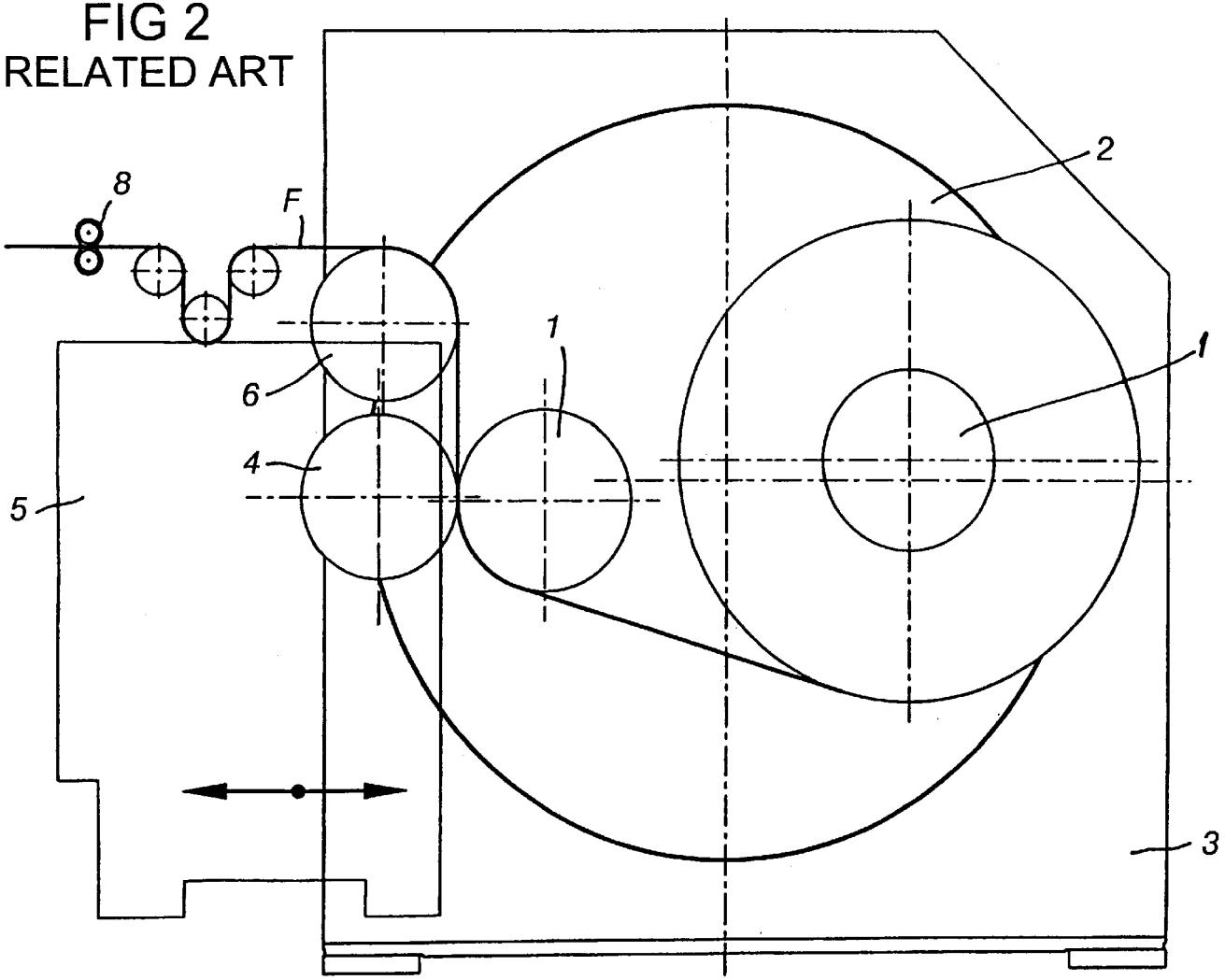
FIG 2 RELATED ART
Figure 5:
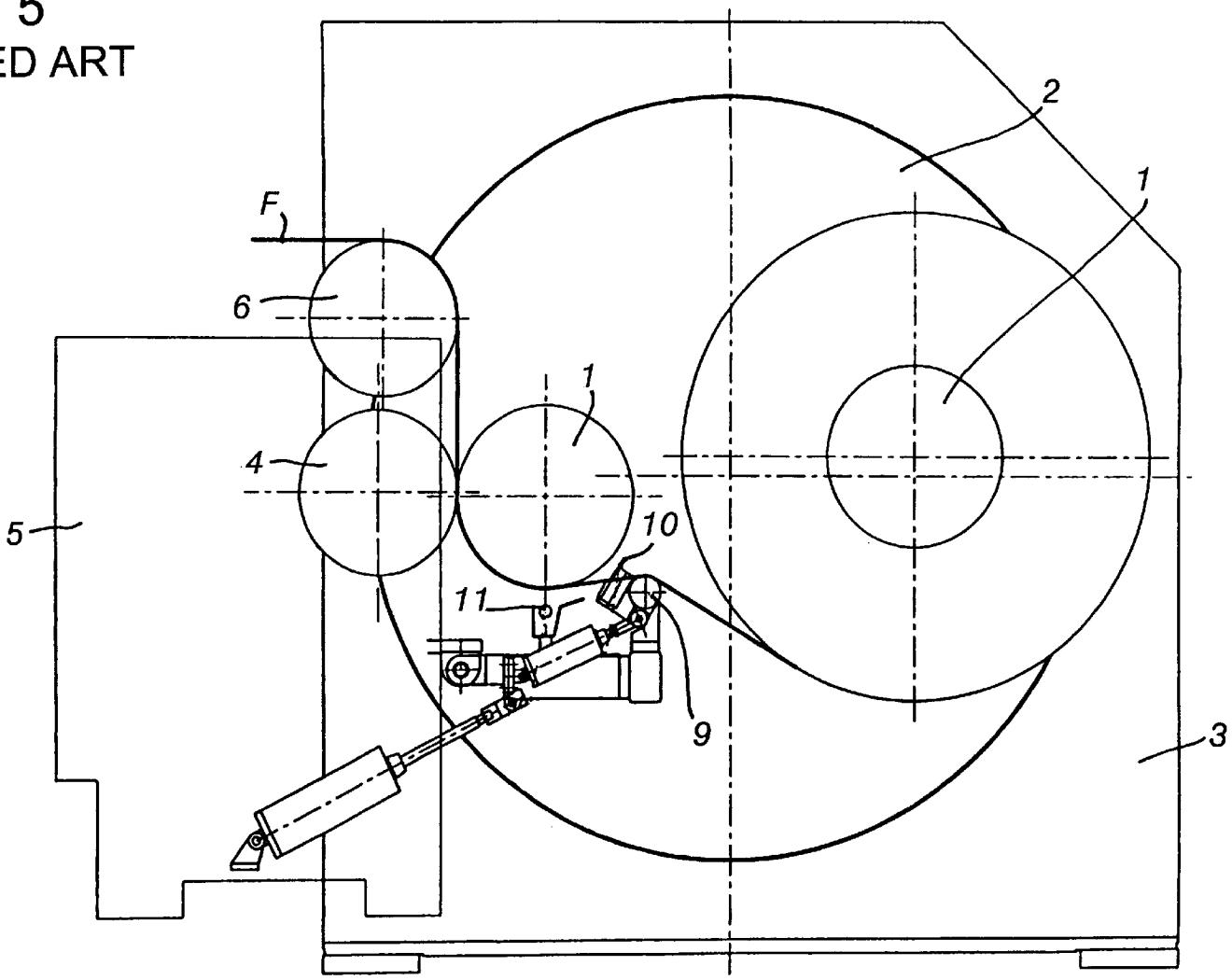
FIG 5 RELATED ART
FIG. 5 is a view of a coiling or winding machine equipped with a known cutting device.
Figure 6:
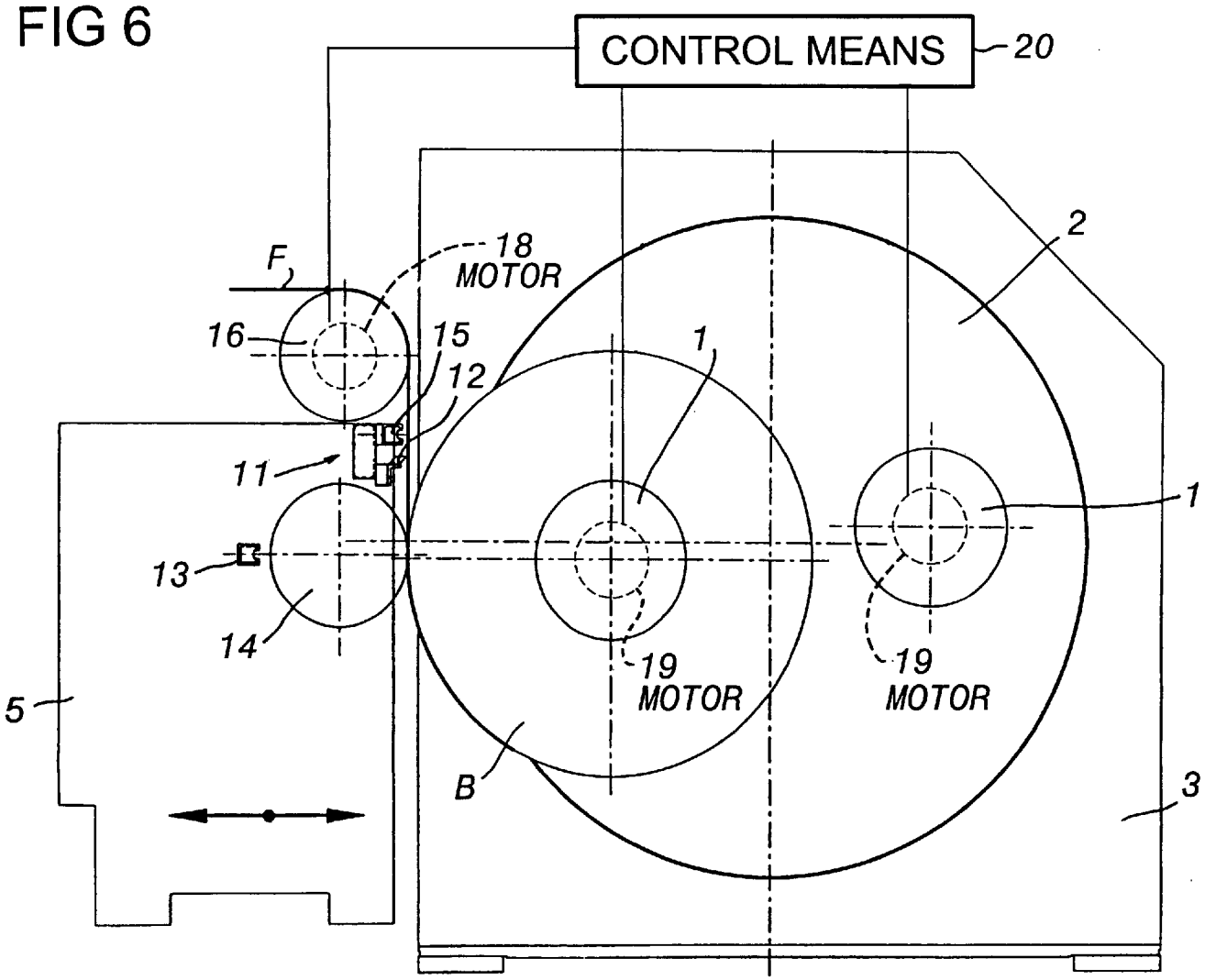
FIG. 6 is a view of a coiling or winding machine equipped with the cutting device according to the invention.
Figure 7:
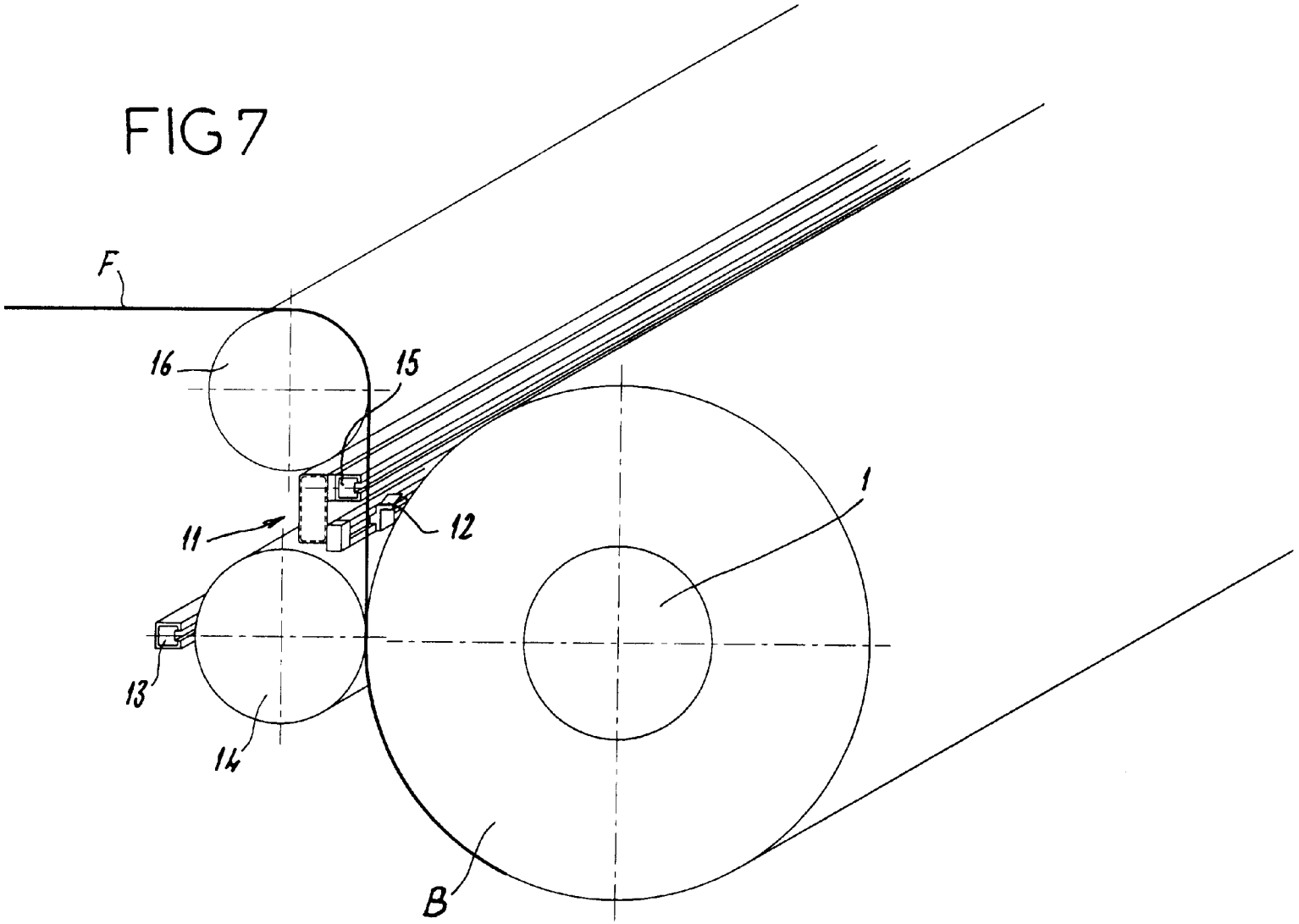
FIG. 7 is a partial perspective view of that part of the machine that comprises the cutting device.

In the coiling or winding machine according to the invention, the carriage 5 is equipped with a horizontal tension-measuring roll 16 on which the sheet (F) arrives roughly horizontally. The carriage 5 also carries a horizontal roll 14, which is a roll for contact with the coil or reel B formed on the spindle 1 or with the spindle 1, prior to the formation of the coil or reel. The roll 14 is parallel to the roll 16, arranged beneath it, and roughly vertically in line with this roll. Placed between the rolls 16 and 14, which are close together, is a cutting device 11. This cutting device comprises a rail on which cutters 12 intended to cut the sheet are mounted so that they can be moved. Just above the supports for the cutters 12 there is an ionizing bar 15, which is intended to be activated just before cutting to electrostatically charge the sheet F and create attraction between the cut part thereof and the coiling or winding spindle 1 or the coil or reel B, as the case may be.

On the opposite side of the roll 14 to the spindle 1 there is a deionizing bar 13, which is activated just before cutting, to remove the electric charge from the surface of the contact roll.

In practice, when a sheet is to be coiled or wound onto a new support, spindle 1 or coil, or reel, B, in so far as the sheet being coiled or wound onto this coil, or reel, has broken, the tension in the sheet F in the region between the measuring roll 16 and the spindle 1 is increased by altering the relative rotational speeds of these two elements by operation of control means 20 on motors 18 and 19, and the pressure of the press roll 14, which may be a contact roll or a roll operating in "gap" mode, is increased slightly. Just before the cut is made, the deionizing bar 13 and the ionizing bar 15 are powered. Thus, the cut is made on a taut surface, allowing a clean cut, the cut end having a tendency, given the speed of the sheet, the proximity of the roll 14 and of the spindle 1, and the respective electric charges on the roll 14 and on the sheet, to coil or wind itself onto the spindle or onto the coil, or reel, where it is a question of feeding back onto a coil, or reel, that has already been begun.

As emerges from the foregoing, the invention provides a great improvement to the existing technique by supplying a machine for coiling or winding a continuous element to form coils or reels, allowing cutting without stopping the coiling or winding, and also allowing coiling or winding to be begun not only on an empty spindle, but also on a coil or reel on which coiling or winding has already begun.

As goes without saying, the invention is not restricted merely to the embodiment of this machine which has been described hereinabove by way of example; on the contrary, it encompasses all variations thereon. Thus, in particular, the number of spindles borne by the turret could differ without in any way departing from the scope of the invention. Further, the term cutter should be broadly constructed. The cutters 12 of the cutting device 11 may be one or more knives or any other device or structure capable of severing the sheet from the coil or reel B.

What is claimed is:

1. Machine for coiling or winding a continuous element in sheet form to form coils, this machine being equipped with a device for cutting the sheet so as to change from one coil to another, of the type comprising a stand on which is mounted a turret equipped with at least two parallel spindles each associated with rotational drive means, the rotation of the turret simultaneously allowing a full coil to be removed and an empty spindle to be brought up to a coiling station, and a carriage that can move at right angles to the axis of the spindles and which itself bears rolls for supplying the machine with sheet that is to be coiled, characterized in that the carriage comprises:

a tension measuring roll for measuring tension on which the sheet arrives roughly horizontally, a contact roll for contact with the coil at the coiling station, the contact roll being placed beneath the tension-measuring roll, roughly vertically in line therewith, and a cutting device placed between the tension-measuring roll and the contact roll, upstream of the point of coiling onto the spindle or the coil that is to be formed.

2. Machine according to claim 1, characterized in that the tension-measuring and contact rolls are motorized.

3. Machine according to claim 2, characterized in that the cutting device comprises moving cutters that move transversely to the sheet feed direction to cut the sheet.

4. Machine according to claim 2, characterized in that its control means, prior to cutting, cause an increase in the tension of the sheet in the region between the tension-measuring roll and the coiling point by altering the speed at which at least one of the spindle and the tension-measuring roll are driven, and an increase in the pressure with which the contact roll is pressed against the spindle or the coil.

5. Machine according to claim 2, characterized in that it comprises, near to the contact roll, a deionization device, which is activated just before cutting, to eliminate the electric charge from the surface of the contact roll.

6. Machine according to claim 2, characterized in that the cutting device comprises cutters, a guide for the cutters, and, near to the guide for the cutters, an ionizing bar extending transversely across the sheet and activated just before cutting so as to electrostatically charge the sheet and create attraction between the cut part and the coiling spindle.

7. Machine according to claim 1, characterized in that the cutting device comprises moving cutters that move transversely to the sheet feed direction to cut the sheet.

8. Machine according to claim 7, characterized in that the speed of travel of the moving cutters is roughly equal to the speed of travel of the sheet.

9. Machine according to claim 8, characterized in that its control means, prior to cutting, cause an increase in the tension of the sheet in the region between the tension-measuring roll and the coiling point by altering the speed at which at least one of the spindle and the tension-measuring roll are driven, and an increase in the pressure with which the contact roll is pressed against the spindle or the coil.

10. Machine according to claim 8, characterized in that it comprises, near to the contact roll, a deionization device, which is activated just before cutting, to eliminate the electric charge from the surface of the contact roll.

11. Machine according to claim 8, characterized in that the cutting device comprises, near to the moving cutters, an ionizing bar extending transversely across the sheet and activated just before cutting so as to electrostatically charge the sheet and create attraction between the cut part and the coiling spindle.

12. Machine according to claim 7, characterized in that its control means, prior to cutting, cause an increase in the tension of the sheet in the region between the tension-measuring roll and the coiling point by altering the speed at which at least one of the spindle and the tension-measuring roll are driven, and an increase in the pressure with which the contact roll is pressed against the spindle or the coil.

13. Machine according to claim 7, characterized in that it comprises, near to the contact roll, a deionization device, which is activated just before cutting, to eliminate the electric charge from the surface of the contact roll.

14. Machine according to claim 7, characterized in that the cutting device comprises, near to the moving cutters, an ionizing bar extending transversely across the sheet and activated just before cutting so as to electrostatically charge the sheet and create attraction between the cut part and the coiling spindle.

15. Machine according to claim 1, characterized in that its control means, prior to cutting, cause an increase in the tension of the sheet in the region between the tension-measuring roll and the coiling point by altering the speed at which at least one of the spindle and the tension-measuring roll are driven, and an increase in the pressure with which the contact roll is pressed against the spindle or the coil.

16. Machine according to claim 15, characterized in that it comprises, near to the contact roll, a deionization device, which is activated just before cutting, to eliminate the electric charge from the surface of the contact roll.

17. Machine according to claim 15, characterized in that the cutting device comprises cutters, a guide for the cutters, and, near to the guide for the cutters, an ionizing bar extending transversely across the sheet and activated just before cutting so as to electrostatically charge the sheet and create attraction between the cut part and the coiling.

18. Machine according to claim 1, characterized in that it comprises, near to the contact roll, a deionization device, which is activated just before cutting, to eliminate the electric charge from the surface of the contact roll.

19. Machine according to claim 1, characterized in that the cutting device comprises cutters, a guide for the cutters, and, near to the guide for the cutters, an ionizing bar extending transversely across the sheet and activated just before cutting so as to electrostatically charge the sheet and create attraction between the cut part and the coiling spindle.

* * * * *